US011694864B2

(12) United States Patent
Li et al.

(10) Patent No.: US 11,694,864 B2
(45) Date of Patent: Jul. 4, 2023

(54) VACUUM INTERRUPTER WITH TRAP FOR RUNNING CATHODE TRACKS

(71) Applicant: Eaton Intelligent Power Limited, Dublin (IE)

(72) Inventors: Wangpei Li, Horseheads, NY (US); Xin Zhou, Wexford, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/038,387

(22) Filed: Sep. 30, 2020

(65) Prior Publication Data

US 2022/0102096 A1 Mar. 31, 2022

(51) Int. Cl.
*H01H 33/662* (2006.01)
*H01H 33/664* (2006.01)

(52) U.S. Cl.
CPC .... *H01H 33/66207* (2013.01); *H01H 33/664* (2013.01); *H01H 33/66238* (2013.01); *H01H 33/66261* (2013.01)

(58) Field of Classification Search
CPC ..... H01H 33/66207; H01H 33/66238; H01H 33/66261; H01H 33/664; H01H 33/6641; H01H 33/6642; H01H 33/6644; H01H 33/6645; H01H 33/6646; H01H 33/59
USPC ..... 218/118, 123, 126–129, 146, 148, 135, 218/136
See application file for complete search history.

(56) References Cited

U.S. PATENT DOCUMENTS 3,210,505 A * 10/1965 Porter ..... H01H 33/12 218/118
3,622,724 A * 11/1971 Sofianek ..... H01H 33/6644 218/127
4,081,640 A * 3/1978 Rich ..... H01H 33/664 218/123
4,110,806 A * 8/1978 Murano ..... H01F 38/023 361/4
4,410,777 A * 10/1983 Sakuma ..... H01H 33/66207 218/139
4,542,266 A 9/1985 Haessler et al.
(Continued)

FOREIGN PATENT DOCUMENTS

CH 532 832 A 1/1973
DE 33 02 201 A1 7/1984
(Continued)

OTHER PUBLICATIONS

European Patent Office "International Search Report and Written Opinion", from corresponding International Application No. PCT/EP2021/025373, dated Jan. 4, 2022, 12 pp.

*Primary Examiner* — William A Bolton
(74) *Attorney, Agent, or Firm* — Eckert Seamans Cherin & Mellott, LLC

(57) ABSTRACT

A vacuum interrupter having a structure to trap running cathode tracks is disclosed. The interrupter includes a first electrode assembly and a second electrode assembly, at least one of which is moveable. The interrupter also includes a sidewall having a longitudinal axis. One or more trench structures are formed in at least one of the electrode assemblies. Each trench structure has an opening that faces the other electrode assembly in a direction that is parallel to the longitudinal axis, to trap the running cathode tracks to prevent them from getting close to the sidewall.

17 Claims, 4 Drawing Sheets

(56) References Cited

U.S. PATENT DOCUMENTS

| | | | | |
|---|---|---|---|---|
| 4,847,456 | A * | 7/1989 | Bamford | H01H 33/12<br>218/141 |
| 5,387,772 | A * | 2/1995 | Bestel | H01H 33/66207<br>218/118 |
| 5,929,411 | A * | 7/1999 | Schulman | H01H 33/66261<br>218/136 |
| 6,765,167 | B2 * | 7/2004 | Kikuchi | H01H 1/0206<br>218/118 |
| 7,906,742 | B2 * | 3/2011 | Steffens | H01H 33/6642<br>218/126 |
| 8,110,769 | B2 * | 2/2012 | Bodenstein | H01H 33/664<br>218/124 |
| 8,575,509 | B2 * | 11/2013 | Marchand | H01H 33/666<br>218/126 |
| 8,710,389 | B2 | 4/2014 | Li et al. | |
| 9,613,769 | B2 * | 4/2017 | Gentsch | H01H 33/38 |

FOREIGN PATENT DOCUMENTS

| | | |
|---|---|---|
| EP | 3 276 648 A1 | 1/2018 |
| GB | 839 083 A | 6/1960 |

* cited by examiner

VACUUM INTERRUPTER WITH TRAP FOR RUNNING CATHODE TRACKS

STATEMENT OF FEDERALLY SPONSORED RESEARCH

This invention was made with United States government support under Contract Number DE-AR0001111 awarded by The United States Department of Energy. The government has certain rights in this invention.

BACKGROUND

This patent document relates to vacuum interrupters, which are sometimes also called vacuum switches. Such vacuum interrupters may be used in hybrid direct current (DC) switching applications, as well as other applications.

Vacuum interrupters are typically used to interrupt electrical current flows. Vacuum interrupters include a generally cylindrical vacuum envelope surrounding a pair of coaxially aligned separable electrode assemblies having opposing contact surfaces. The contact surfaces abut one another in a closed circuit position and are separated to open the circuit. Each electrode assembly includes at least an arcing contact, an electrode that extends outside the vacuum envelope and connects to an electrical circuit, and a seal cup that forms part of the vacuum envelope.

An arc is typically formed in the gap in between the contact surfaces when the contacts are moved apart to the open circuit position while carrying current. The arcing continues until the current is interrupted. Interaction between the vacuum arc and the contact surfaces leads to erosion of the contact and eroded products in the form of metal vapor, liquid droplets, solid particles, and/or splashes containing both liquid and solid of the contact material. To protect the dielectric strength of the ceramic insulator from degradation caused by deposition of these electrically conductive eroded products, protection shields are typically employed around one or both electrodes, covering at least the portion of the interior wall of the ceramic that is visible in direct line of sight from the contact gap. At least one such shield is needed for the majority of applications of a vacuum interrupter, especially when the magnitude of the current to be interrupted is high and the duration of the arcing is long, such as in the case of interruption of AC (alternating current) load or fault currents.

However, the use of a shield limits the diameter of the electrodes, increases the size of the interrupter, and can limit the dielectric and current carrying capabilities of the interrupter. This can be especially undesirable in hybrid DC switching applications. Moreover, in low arcing duty hybrid DC switching applications, erosion of the metal components of a vacuum interrupter takes place mainly in the form of running cathode tracks, and there is a risk for them to get very close to the interior wall of the ceramic to cause dielectric degradation of the interrupter.

This document describes methods and systems that address at least some of the issues described above.

SUMMARY

In various embodiments, a vacuum interrupter includes a first electrode assembly that includes a first electrode, and a second electrode assembly that includes a second electrode. The vacuum interrupter also may include a sidewall having a longitudinal axis. A first trench structure is formed in the first electrode assembly. The first trench structure has an opening that faces the second electrode assembly in a direction that is parallel to the longitudinal axis, to trap an arc from running along the edge of the first electrode assembly during arcing.

In some embodiments, the first trench structure is formed directly in the first electrode. In other embodiments, the first electrode assembly comprises a bellows shield that surrounds the first electrode, and the first trench structure is formed in the bellows shield.

In various embodiments, the vacuum interrupter also includes a first contact that is connected to the first electrode assembly, and a second contact that is connected to the second electrode assembly and positioned to face the first contact. The first trench structure may be positioned radially around the first contact. As an additional option, the first trench structure may include multiple trenches arranged in concentric circles around the first contact.

Optionally, the first electrode assembly comprises a cathode.

In some embodiments, each of the first contact and the second contact consist essentially of a material that has a high boiling point and high minimum arc current. For example the contacts may consist essentially of: (a) tungsten; or (b) a composite of tungsten-copper, tungsten-tungsten carbide-copper (W—WC—Cu), or tungsten-silver (W—Ag).

Optionally, the interrupter also includes a second trench structure formed in the second electrode assembly, wherein the second trench structure also has an opening that faces the first electrode assembly in the direction that is parallel to the longitudinal axis (i.e., that faces a gap between the electrode assemblies).

In various embodiments, the vacuum interrupter may not include any shield positioned between the touch points of the electrode assemblies and an interior wall of ceramic portion of the vacuum envelope that holds the first and second electrode assemblies.

Optionally, the vacuum interrupter may be a component of a hybrid direct current (DC) switch that also includes a DC interrupter.

BRIEF DESCRIPTION OF THE DRAWINGS

FIG. 1A shows a vacuum interrupter with a floating shield, while FIG. 1B shows the vacuum interrupter with a fixed shield.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

In this document, when terms such "first" and "second" are used to modify a noun, such use is simply intended to distinguish one item from another, and is not intended to require a sequential order unless specifically stated. The terms "about" and "approximately," when used in connection with a numeric value, is intended to include values that are close to, but not exactly, the number. For example, in some embodiments, the term "approximately" may include values that are within +/−10 percent of the value When used in this document, terms such as "top" and "bottom," "upper" and "lower," or "above" and "below," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The drawings are not to scale. The claims are intended to include all orientations of a device containing such components.

"Medium voltage" (MV) systems include electrical systems that are rated to handle voltages from about 600 V to about 1000 kV. Some standards define MV as including the voltage range of 600 V to about 69 kV. (See NECA/NEMA 600-2003). Other standards include ranges that have a lower end of 1 kV, 1.5 kV or 2.4 kV and an upper end of 35 kV, 38 kV, 65 kV or 69 kV. (See, for example, IEC 60038, ANSI/IEEE 1585-200 and IEEE Std. 1623-2004, which define MV as 1 kV-35 kV.) Except where stated otherwise, in this document the term "medium voltage" is intended to include the voltage range from approximately 1 kV to approximately 100 kV, as well as all possible sub-ranges within that range.

Figure 1A:
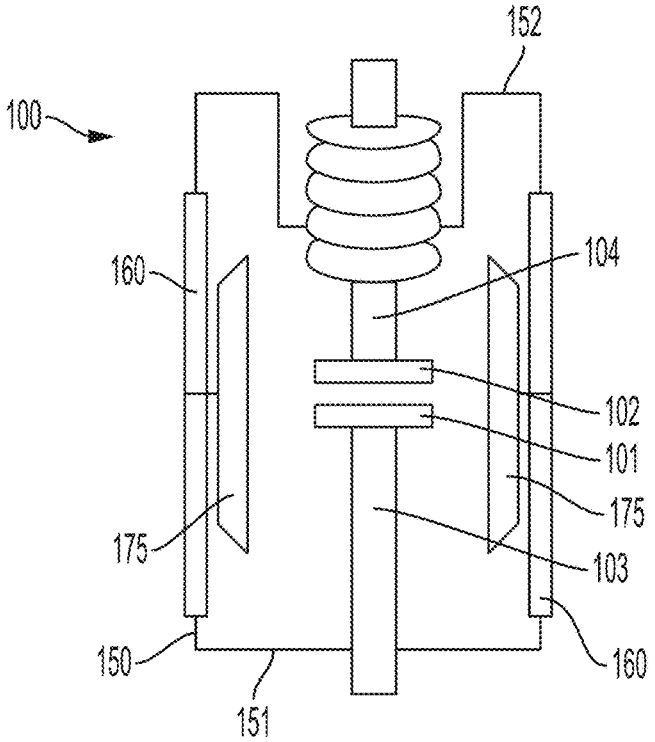
FIG. 1A PRIOR ART
FIGS. 1A and 1B illustrate example components of a vacuum interrupter, such as may exist in the prior art.
Figure 1B:
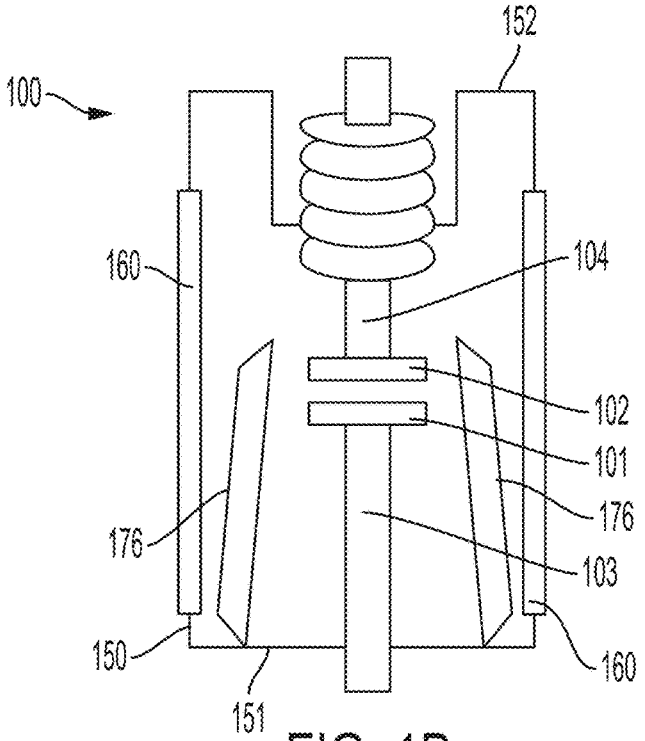
FIG. 1B PRIOR ART

FIGS. 1A and 1B illustrate a cross-sectional view of an example vacuum switch, also known as a vacuum interrupter, such as may exist in the prior art. The vacuum interrupter 100 includes a vacuum envelope 150, which serves as a housing in which a vacuum exists to assist in interrupting current flow. The vacuum envelope 150 is typically cylindrical, and the view shown in FIGS. 1A and 1B is a cross-section of a cylinder. A fixed contact 101 is partially within the vacuum envelope 150. A movable contact 102 is also partially within the vacuum envelope 150, Moveable contact 102 is movable (e.g., up and down from the perspective of FIGS. 1A and 1B) between a closed position in electrical contact with the fixed contact 101, and an opened position spaced apart from the fixed contact 101. The vacuum envelope 150 includes first and second opposing ends 151, 152. The interior of the vacuum envelope 150 includes sidewalls 160 typically formed of an insulating material having high dielectric strength, such as ceramic.

In the examples of FIGS. 1A and 1B, the vacuum interrupter 100 includes a fixed electrode assembly 103 that includes the fixed contact 101, and one or more electrodes that are electrically connected to the fixed contact 101, and a moveable electrode assembly 104 that includes the moveable contact 102, and one or more electrodes that are electrically connected to the movable contact 102. The electrode assemblies 103, 104 extend from their corresponding contacts 101, 102 toward either the first end 151 of the vacuum envelope 150 or the second end 152 of the vacuum envelope 150. One of the electrode assemblies 103, 104 serves as the anode, and the other serves as the cathode, of the vacuum interrupter in a directional current flow of a DC, and alternates as cathode and anode in a bi-directional current flow of an AC.

In typical AC applications, a vacuum interrupter may have an arcing duty in the range of >1 kiloamps (kA) for >1 millisecond of duration. To protect the dielectric strength of the ceramic insulator portion of the sidewall 160 of the vacuum envelope 150 from degradation caused by deposition of the metal vapor and splashes from this heavy arcing duty, at least one ceramic protection shield is needed. The shield may be formed of stainless steel, copper, an assembly of a Cu—Cr powder metallurgy piece and 2 stainless steel ends, or any other material. FIG. 1A illustrates an example with an electrically floating shield 175, which is not electrically attached to either end of the vacuum interrupter. Such a floating shield can evenly distribute the dielectric stress between the contacts and thus optimally shape the voltage distribution inside and outside of the vacuum interrupter. However, attachment of the floating shield 175 to the insulating ceramic of the sidewall 160 results in manufacturing difficulties for the vacuum interrupter and adds to its cost of manufacturing. Therefore a vacuum interrupter with an electrically fixed shield, as shown in FIG. 1B is often designed and manufactured, in which the ceramic protection shield 176 is both mechanically and electrically fixed to one end of the vacuum interrupter (in this case the end 151 that includes the fixed terminal).

While the shield is helpful, a shield can lead to high electric fields at the corner of the contact, and to even higher electric fields at the tip of the shield around which the field wraps, especially in the case of a fixed shield. The shield also limits the diameters of the electrodes, as the shield takes up space within the vacuum envelope.

With its superbly high dielectric strength per unit length of the gap between the pair of electric contacts, the vacuum interrupter is finding itself uniquely fit for ultrafast operation needed for DC switching applications. Combining this with its fast dielectric recovery strength immediately after extinction of arcing (and minimal degradation of its low contact resistance over life time), the vacuum interrupter is becoming the preferred choice as the mechanical switch in a hybrid DC switching scheme.

In such a hybrid DC switching applications, the vacuum interrupter is called upon to either interrupt a very small high frequency current, or merely to commutate the flow of a current. The arcing duty experienced by the vacuum interrupter is in the order of single or double digit Amperes and for a duration only in the order of tens of microseconds or even less. As these hybrid DC switches are often intended to be used in a confined space such as on-board naval or aeronautic vehicles, it is desirable to have a high current caring capability per unit volume of the vacuum interrupter. This newly found combination of high dielectric and high current carrying demand but low arcing duty need makes it very desirable for the vacuum interrupter to not have the aformentioned ceramic protection shield, especially if cost of manufacturing is taken into consideration.

Figure 2A:
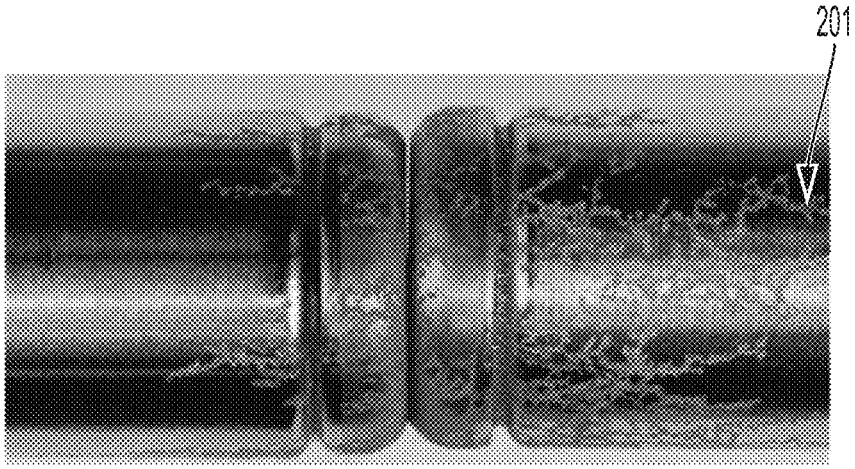
FIG. 2A is a photo showing how cathode tracks may track on the surface of the copper electrode of a vacuum interrupter.
Figure 2B:
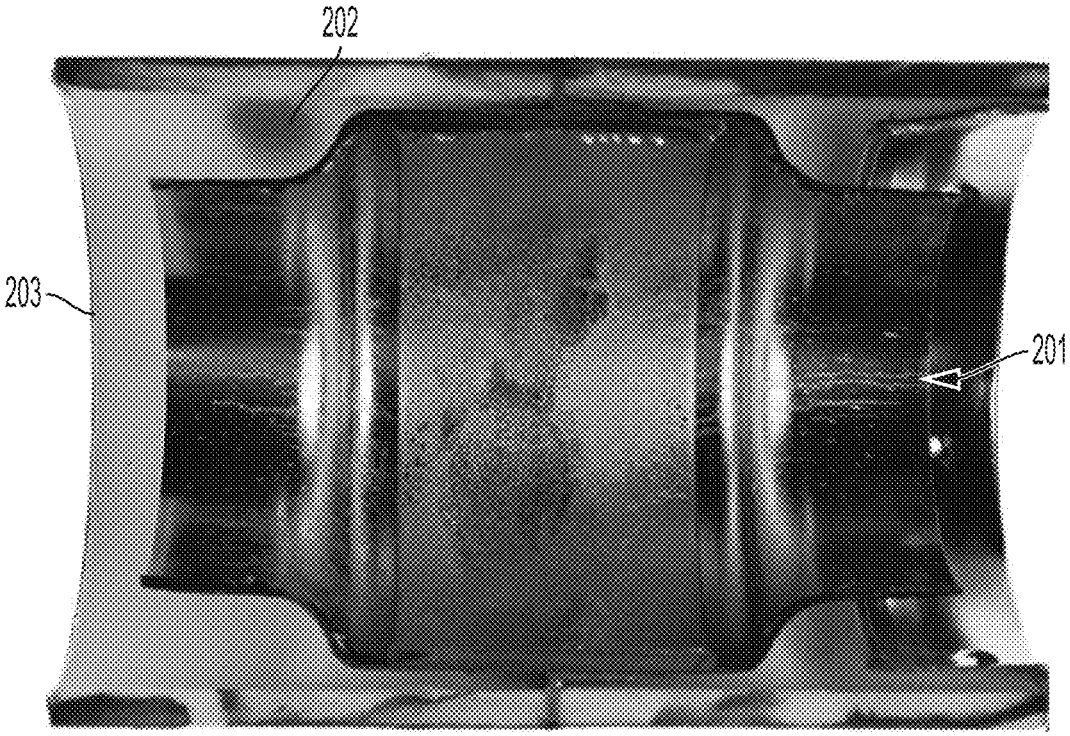
FIG. 2B is a photo showing cathode tracks formed on the stainless steel portions of a floating shield assembly, and corresponding metal deposits on an interior wall of the ceramic body.

However, if the shield is eliminated, the interior wall of the ceramic cylinder 160 still needs to be protected from deposition of metal vapor generated in the limited but still finite arcing. Unlike the direct evaporation of the contacts by high intensity arcing in the case of heavy AC interruption, in this case of low current limited arcing in a hybrid switch, the main mechanism of metal vapor generation is by the cathode tracks, which are aggregates of shallow craters, sometimes called cathode spots, that are formed on the opening contact of the cathode and run along the cathode's face and down the toward the interior wall by the cathode end of a running vacuum arc, and the major risk of dielectric degradation of the ceramic interior wall is flashing of metal vapor from cathode tracks that have run very close to the ceramic wall. The likelihood of the cathode tracks running close to the ceramic wall is increased when a large electrode, as large as the interior diameter of the ceramic cylinder allows, is designed for the desire to maximize the current carrying capability of the electrode and hence the vacuum interrupter. FIG. 2A is a photo showing cathode tracks 201 that have initiated at the arcing CuW contact surface, rundown over its edge, and tracked along the surface of the copper electrode, while FIG. 2B is a photo showing cathode tracks 201 formed on the stainless steel portions of a floating shield assembly, and a spot of metal flashing 202 on the otherwise white and clean interior wall of the ceramic cylinder 203, that likely came from arcing activities from the nearby cathode tracks.

To address this, the inventors have found that a means to trap the running of cathode tracks along the electrode(s) of a vacuum interrupter is possible, and is especially useful in hybrid DC switching applications. This is accomplished by one or more trenches that are machined or formed in a portion of the electrode assembly, either on the electrode itself or on the bellows shield, in a radial position in between the outside diameter edge of the contact and the interior wall of the ceramic cylinder. The opening of the trench may face the space that exists between the electrodes, to effectively stop or substantially reduce the radial motion of the cathode tracks from the contact surface to the interior wall of the ceramic cylinder.

Figure 3:
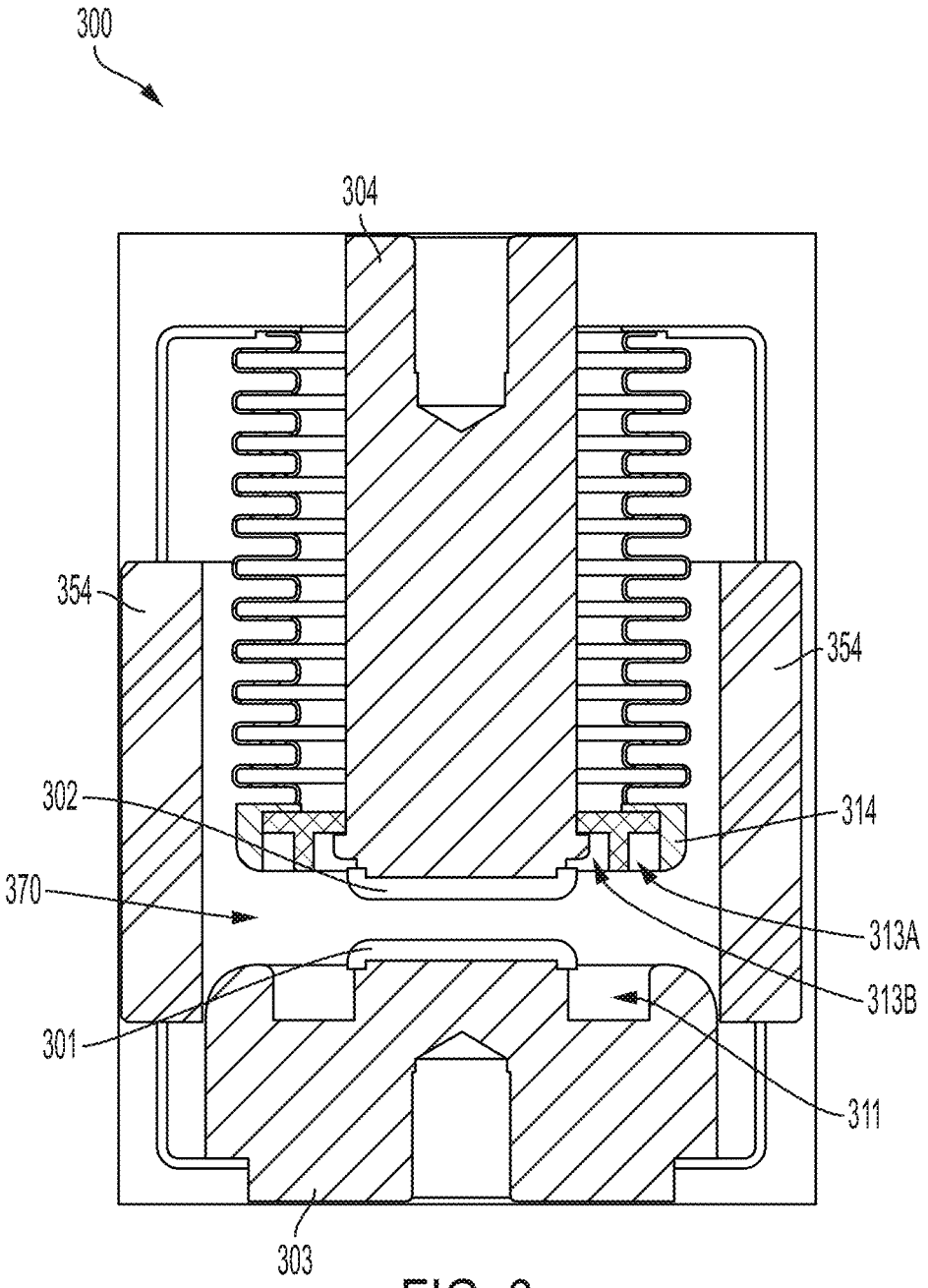
FIG. 3 illustrates an example structure to trap running cathode tracks in a vacuum interrupter.

FIG. 3 illustrates various examples of how this may be accomplished. As shown in FIG. 3, a vacuum interrupter 300 includes a fixed electrode assembly 303 that includes a fixed contact 301 and a moveable electrode assembly 304 that includes a moveable contact 302, along with other elements such as the electrode itself, a bellows shield, a seal cup positioned between the electrode and the housing sidewall, and/or other components. The vacuum interrupter 300 is shown in an open position, and a space 370 exists between the electrode assemblies 303, 304 and contacts 302, 302. (In an open position, the space 370 includes the contact gap and the space between the electrodes that surrounds the contacts.) A trench structure 311 is shown as formed into the fixed electrode assembly 303 as a circle, in a radial position between the contact 301 and the outer edge of the moveable electrode assembly 304. The trench structure 311 may be machined into the fixed electrode assembly 303, formed by molding, or otherwise made part of the fixed electrode assembly 303. A trench structure 311 such as that shown may be formed in the fixed electrode assembly 303, the moveable electrode assembly 304, or both.

In addition or alternatively, the trench structure may be in the form of two or more concentric trenches 313A, 313B, which in the example shown are attached to a bellows shield 314 that surrounds the moveable electrode assembly 304 (to protect the bellows from the arc). Each trench structure 313A, 313B is shown as formed into the moveable electrode assembly 304 as a circle, in a radial position between the outer edge of the contact 302 and the outer edge of the electrode assembly 303. Concentric trenches 313A, 313B may be formed in either or both electrode assemblies 303, 304, either directly (such as by machining) or via bellows shield 314, which in some embodiments may be of the type that is a dummy shield 314 that is attached to the corresponding electrode assembly's electrode.

Each trench structure 311, 313A, 313B formed in either electrode assembly 303, 304 has an opening that faces the other electrode assembly (i.e., toward the space 370) in an axial direction that is parallel to the longitudinal axis of the sidewall 354 of the vacuum envelope. (In FIG. 3, the longitudinal axis runs in the vertical direction.)

Note that in FIG. 3, the opening of each trench is not on the same plane as the contacting face of the contact that is attached to the electrode assembly in which the trench is formed. Instead, the opening of each trench is lower (in the case of an upwardly-facing contract) or higher (in the case of a downwardly-facing contact) than the edge of the contact. Thus, when the vacuum interrupter is closed and the contacts 301, 302 touch each other, the contact gap is closed but the space 370 will still exist between electrode assemblies 303, 304, although its size will be reduced to not include any portion between the contacts since the contacts will be touching.

At a minimum, one or more trenches to trap running cathode tracks will be formed around the contact of the electrode assembly that serves as the cathode. However, trenches may be employed on both electrode assemblies, especially in installations where the direction of current flow may be reversed.

Trench structures may be of any suitable shape, including rectangular (parallel flat sidewalls with a perpendicular flat bottom) as shown in FIG. 3, flat sidewalls with curved bottoms (as in a half-pipe shape), V-shaped, or otherwise formed.

Optionally, to further improve the protection of the ceramic wall by reducing the generation of metal vapor due to arc erosion of the contact, in some embodiments either or both contacts 301, 302 may be formed of a material having a boiling point and minimum arc current (i.e., the minimum current that must be present for the arc to be maintained) that are higher than those of copper or silver or chromium. Examples of such materials are pure tungsten W (with "pure" meaning substantially pure, allowing for trace impurities), or a composite of tungsten W with copper Cu (W—Cu alloy), tungsten with tungsten carbide and copper (W—WC—Cu alloy), or tungsten with silver (W—Ag alloy), in each case with the W (or W+WC) making up >95 weight-percent of the composite.

With a structure such as that described above, the vacuum interrupter 300 may not have any shield present between the contacts 301, 302 and the inner sidewall 354 of the vacuum envelope, although the invention is not limited to embodiments that omit a shield.

Figure 4:
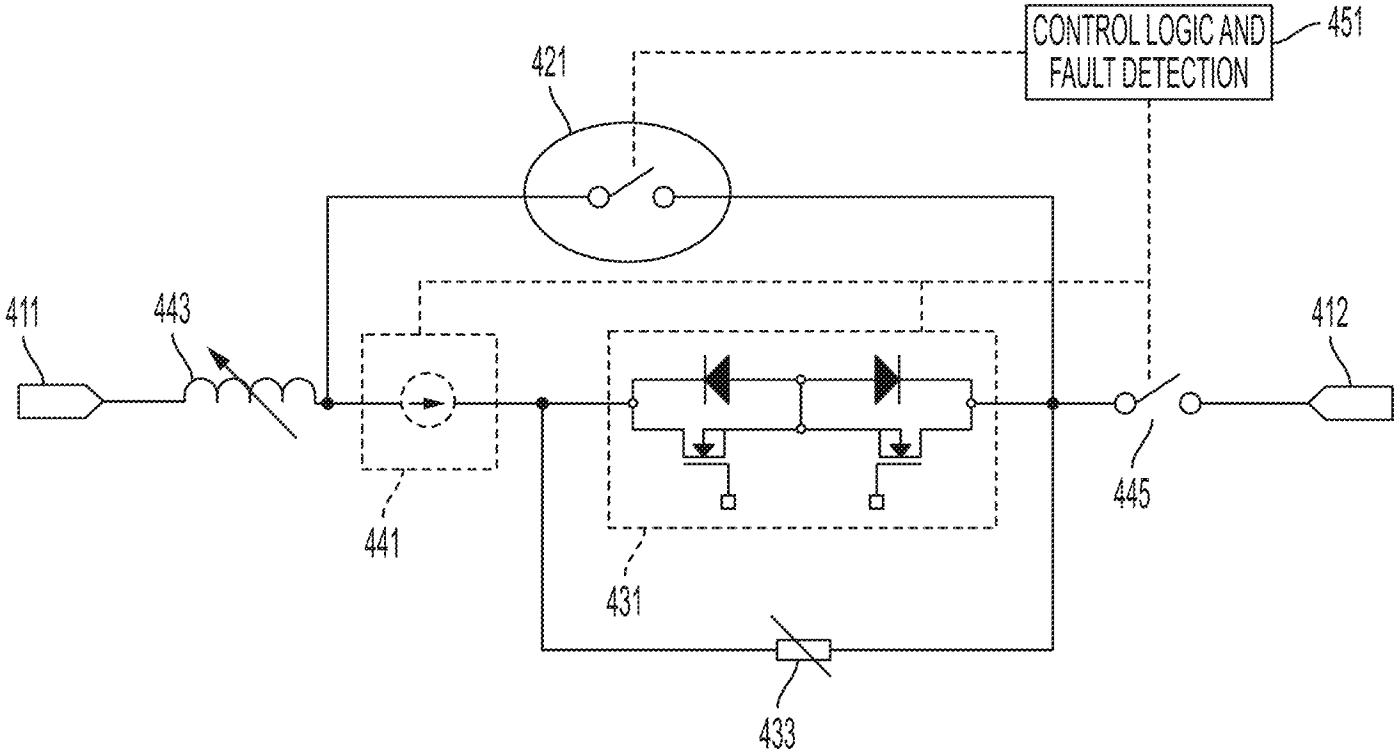
FIG. 4 illustrates example components of a hybrid circuit breaker.

FIG. 4 illustrates example components of a hybrid DC circuit breaker that may employ a vacuum interrupter with cathode track traps as described above. The hybrid DC circuit breaker is configured to pass—and interrupt—the delivery of current from a DC power input line to a load in various embodiments. In the example of FIG. 4, first terminal 411 may lead to the input and second terminal 412 may lead to the load, or the elements may be reversed so that current flow is in the opposite direction. The system includes a vacuum interrupter 421 that is electrically connected between the DC input 411 and the load 412. The system also includes a power electronics branch that includes a DC solid state (i.e., electronic) power interrupter 431 that is electrically connected in parallel with the vacuum interrupter 421, and which also is electrically connected between the DC input and the load. The power electronics branch also may include a transient commutation current injector 441 that can draw current away from the vacuum interrupter 421 and generate low level high frequency current with current zero crossing in the vacuum interrupter 421 by injecting current into the power electronics branch as will be described below.

The system may include an isolation switch 445 with an input terminal that is electrically connected to the inputs or the outputs of the vacuum circuit interrupter 421 and of the DC electronic interrupter 431. The output terminal of the isolation switch 445 is shown as electrically connected to the second terminal 412. However, in some embodiments either terminal of the isolation switch may be instead electrically connected to the first terminal 411 and thus will be positioned between the first terminal 411 and the power electronics branch. In DC applications one of the electrode assemblies within the vacuum circuit interrupter 421 serves as the anode, and the other serves as the cathode, and their roles may be reversed depending on the direction of DC current flow.

The hybrid circuit interrupter will include fault detection circuitry (such as a ground fault sensor) and control logic circuitry 451 that are configured to actuate various components of the circuit upon detection of an interrupt condition. The interrupt condition may be receipt of a command to interrupt the flow of current to the load, or it may be detection of a fault (such as a short-circuit) condition that will trigger interruption of current to avoid damaging the load and/or other components of the system.

The system may include additional components such as a varistor 433 that is electrically connected in parallel with the electronic interrupter. The varistor 433 can serve the function of a surge arrestor to limit the voltage across the electronic interrupter 431 and absorb any residual current when interrupting occurs. The system also may include a variable inductor 443 that is electrically connected between the line and the inputs of the vacuum circuit interrupter and the electronic interrupter.

Optionally, a current injector 441 may be positioned upstream of the electronic power interrupter 431 as shown, or it may be positioned downstream of the electronic power interrupter 431. In various embodiments, the current injector 441 may be either unidirectional to handle a single direction of current flow, or it may be bidirectional to handle current flow in either direction.

The electronic interrupter (431 in FIG. 4) may be any suitable solid-state DC circuit breaker, such as those that have a medium voltage rating but compact size. Suitable examples are described in U.S. Pat. No. 9,103,852 (Zheng et al), the disclosure of which is fully incorporated into this document by reference.

In addition to hybrid DC circuit applications such as those described above, a vacuum interrupter with trench structure as described in this document may be used in other applications, such as AC current limiters and other electrical equipment.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A vacuum interrupter, comprising:

a first electrode assembly that comprises a first electrode and a first contact situated on the first electrode;

a second electrode assembly that comprises a second electrode;

a sidewall having a longitudinal axis; and a first trench structure formed in the first electrode assembly as a circle, wherein the first trench structure has an opening that faces the second electrode assembly in a direction that is parallel to the longitudinal axis, to trap an arc from running along an edge of the first electrode assembly during arcing, wherein:

the first electrode assembly is a moveable electrode assembly and comprises a bellows shield that surrounds at least a portion of the first contact, and wherein a second trench structure is formed in the first electrode assembly and is concentric with the first trench structure.

2. The vacuum interrupter of claim 1, further comprising:

a first contact that is connected to the first electrode assembly; and a second contact that is connected to the second electrode assembly and positioned to face the first contact, wherein the first trench structure is positioned radially around the first contact.

3. The vacuum interrupter of claim 2, wherein each of the first contact and the second contact consist essentially of:

tungsten; or a composite of tungsten-copper, tungsten-tungsten carbide-copper (W—WC—Cu), or tungsten-silver (W—Ag).

4. The vacuum interrupter of claim 2, wherein each of the first contact and the second contact consist essentially of a material that has a high boiling point and high minimum arc current.

5. The vacuum interrupter of claim 1, wherein the first electrode assembly comprises a cathode.

6. The vacuum interrupter of claim 1, wherein the second trench structure also has an opening that faces the first electrode assembly in the direction that is parallel to the longitudinal axis.

7. The vacuum interrupter of claim 1, wherein the vacuum interrupter does not include any shield positioned between a gap that is between the electrode assemblies and an interior wall of a vacuum envelope that holds the first and second electrode assemblies.

8. A hybrid direct current (DC) switch, comprising:

a DC interrupter; and a vacuum interrupter electrically connected in parallel with the DC interrupter, the vacuum interrupter comprising:

a first electrode assembly that comprises a first electrode and a first contact situated on the first electrode, a second electrode assembly that comprises a second electrode, a sidewall having a longitudinal axis, and a first trench structure formed in the first electrode assembly as a circle, wherein the first trench structure has an opening that faces the second electrode assembly in a direction that is parallel to the longitudinal axis, to trap metal depositions from running along an edge of the first electrode assembly during arcing, wherein:

the first electrode assembly is a moveable electrode assembly and comprises a bellows shield that surrounds at least a portion of the first contact, wherein a second trench structure is formed in the first electrode assembly and is concentric with the first trench structure.

9. The hybrid DC switch of claim 8, further comprising:

a first contact that is connected to the first electrode assembly; and a second contact that is connected to the second electrode assembly and positioned to face the first contact, wherein the first trench structure is positioned radially around the first contact.

10. The hybrid DC switch of claim 9, wherein each of the first contact and the second contact consist essentially of:

tungsten; or a composite of tungsten-copper, tungsten-tungsten carbide-copper (W—WC—Cu), or tungsten-silver (W—Ag).

11. The hybrid DC switch of claim 9, wherein each of the first contact and the second contact consist essentially of a material that has a high boiling point and high minimum arc current.

12. The hybrid DC switch of claim 9, wherein the vacuum interrupter does not include any shield positioned between a gap that is between the electrode assemblies and an interior wall of a vacuum envelope that holds the first and second electrode assemblies.

13. The hybrid DC switch of claim 8, wherein the first electrode assembly comprises a cathode.

14. The hybrid DC switch of claim 8, wherein the second trench structure also has an opening that faces the first electrode assembly in the direction that is parallel to the longitudinal axis.

15. A vacuum interrupter, comprising:

a first electrode assembly that comprises a first electrode and a first contact situated on the first electrode;

a second electrode assembly that comprises a second electrode;

a sidewall having a longitudinal axis; and a first trench structure formed as a circle in one of the first electrode assembly and the second electrode assembly, wherein the first trench structure has an opening that faces the other of the first electrode assembly and the second electrode assembly in a direction that is parallel to the longitudinal axis to trap an arc from running along an edge of the one of the first electrode assembly and the second electrode assembly during arcing, wherein:

the first electrode assembly is a moveable electrode assembly and comprises a bellows shield that surrounds at least a portion of the first contact; and the second electrode assembly is fixed, and wherein the first trench structure formed in the first electrode assembly, and wherein a second trench structure is formed in the first electrode assembly and is concentric with the first trench structure.

16. The vacuum interrupter of claim 15, wherein a third trench structure is formed in the second electrode assembly and is concentric with the first trench structure and the second trench structure.

17. The vacuum interrupter of claim 15, wherein the first trench structure formed in the first electrode assembly, and wherein the second trench structure is formed as a circle in the second electrode assembly.

* * * * *